United States Patent [19]

Sieber

[11] 4,037,402

[45] July 26, 1977

[54] CIRCUIT ARRANGEMENT FOR A QUARTZ CONTROLLED ELECTRICAL CLOCK

[75] Inventor: Paul Sieber, Heilbronn-Bockingen, Germany

[73] Assignee: Licentia Patent-Verwaltungs-G.m.b.H., Frankfurt am Main, Germany

[21] Appl. No.: 557,879

[22] Filed: Mar. 12, 1975

[30] Foreign Application Priority Data

Mar. 29, 1974 Germany ..... 2415291

[51] Int. Cl.[2] ..... G04B 27/00

[52] U.S. Cl. ..... 58/85.5; 58/23 R

[58] Field of Search ..... 58/23 R, 23 AC, 34, 58/35 R, 85.5

[56] References Cited

U.S. PATENT DOCUMENTS

| | | | |
|---|---|---|---|
| 3,363,410 | 1/1968 | Imahashi | 58/23 AC |
| 3,678,680 | 7/1972 | Fujita | 58/34 |
| 3,691,753 | 9/1972 | Kurita | 58/23 R |
| 3,768,247 | 10/1973 | Fujita | 58/23 R |
| 3,800,233 | 3/1974 | Sauthier | 58/23 AC |
| 3,823,546 | 7/1974 | Gortz | 58/23 R |
| 3,828,278 | 8/1974 | Rees | 58/23 AC |
| 3,834,152 | 9/1974 | Nishimura | 58/23 R |
| 3,841,081 | 10/1974 | Komaki | 58/23 R |

*Primary Examiner*—Robert K. Schaefer
*Assistant Examiner*—Vit W. Miska
*Attorney, Agent, or Firm*—Spencer & Kaye

[57] ABSTRACT

A circuit arrangement for a quartz controlled electrical clock comprising an oscillator stage a frequency divider separated from the oscillator stage by a gate controlled by a control logic unit, an output stage connected to the frequency divider and a stepping motor connected to the output stage, the control logic unit responding to a command signal to open the gate and disconnect the oscillator stage from the frequency divider with the frequency divider retaining its memory content at the instant of disconnection and with no current flowing through the drive coils of the stepping motor.

6 Claims, 2 Drawing Figures

CIRCUIT ARRANGEMENT FOR A QUARTZ CONTROLLED ELECTRICAL CLOCK

BACKGROUND OF THE INVENTION

The invention relates to a circuit arrangement for a quartz-controlled electrical clock comprising an oscillator stage, frequency divider stages, output stages and a stepping switch motor.

The circuits for quartz-controlled clocks, which have become known up to the present, having frequency dividers and stepping switch motors as the hand drive, have the important disadvantage of an undully long starting time.

To set the clock, the supply voltage is disconnected from the oscillator and from the frequency divider. Then the hands or the numerical indicators are set to the desired clock time. In order to restart the clock thereafter the supply voltage is applied to the integrated circuit built into the clock via the switch connected to the setting crown. This integrated circuit contains the oscillator, the frequency divider and the necessary output stages and is as a rule constructed with MIS field effect transistors. These transistors have a control electrode separated from the channel region by an insulating layer.

Up to the start of the second hand or the second numeral indicator, there results after the closure of the switch, still further delay times necessitated by the circuit design concept:

a. build-up period of the oscillator: according to the operating voltage up to 1 sec.

b. time period up to the appearance of the first pulse at the output stages which pulse drives the motor in the correct direction in accordance with the final position of the motor on disconnection of the clock: maximally 2 sec.

For clocks which must not be incorrect in the course of a year by more than a few seconds, a setting accuracy of 2 to 3 seconds is not serviceable.

SUMMARY OF THE INVENTION

It is an object of the present invention to provide a circuit arrangement through which, after the setting of the clock, the further running of the clock is ensured in a time period which is as short as possible.

According to a first aspect of the invention, there is provided a circuit arrangement for a quartz controlled electrical clock comprising an oscillator stage, a frequency divider, a gate circuit between said oscillator stage and said frequency divider, an output stage connected to said frequency divider, a stepping motor connected to said output stage, and a control logic unit connected control operation of said gate circuit and responsive to a command signal to open said gate circuit to disconnect said oscillator stage from said frequency divider with said frequency divider retaining its memory content at the instant of disconnection, and with no current flowing through the drive coils of said stepping motor.

According to a second aspect of the invention, there is provided a circuit arrangement for a quartz-controlled electrical clock comprising an oscillator stage, frequency divider stages, output stages and a stepping switch motor, characterized in that a switch connected to a control logic unit is provided, in that said control logic unit is linked to a gate circuit connected between said frequency divider and said oscillator, and in that said control logic unit is so designed that, on closure of said switch said oscillator and the gate circuit are so disconnected from said frequency divider that the memory content of said frequency divider is retained at the instant of disconnection, no current flows through the drive coils of the motor and the next pulse driving the motor lies immediately ahead.

BRIEF DESCRIPTION OF THE DRAWINGS

The invention will now be described in greater detail, by way of example, with reference to the drawings, in which.

DESCRIPTION OF THE PREFERRED EMBODIMENT

Basically the invention proposes that, in a circuit arrangement for a quartz-controlled electrical clock comprising an oscillator stage, frequency divider stages, output stages and a stepping switch motor, a switch connected to a control logic unit is provided, that the control logic unit is linked to a gate circuit connected between the frequency divider and oscillator, and that the control logic is so designed that on closing the switch the oscillator is so disconnected from the frequency divider by the gate circuit that the memory content is retained at the instant of disconnection, the drive coils of the motor are current-free and the subsequent pulse driving the motor is directly ahead.

Since in the case of this circuit arrangement, the frequency divider of the oscillator is stopped in that state, in which a pulse emission to the motor lies ahead and the state of the frequency divider is also retained on setting the clock, all the delay times are avoided. On reconnection of the clock, the next pulse coming out of the oscillator triggers the directionally correct pulse emission to the motor, so that the setting accuracy amounts to $1/f_{osc}$. Since normally, operating is effected with an oscillator frequency of 32 Khz, the maximum setting error amounts to 31.15 $\mu$s. Since the control logic unit provides for the fact that the clock can be set only in the case of current-free drive coils, it is also ensured that during the setting of the clock the current drain remains extremely small. Were the said condition not fulfilled, it could happen that, during the entire setting time, a current flows through a drive coil of the motor so that the supply battery would be rapidly used up.

The gate circuit can comprise one of the known logic linking elements, for example an AND, an OR, a NOR or a NAND circuit.

Figure 1:
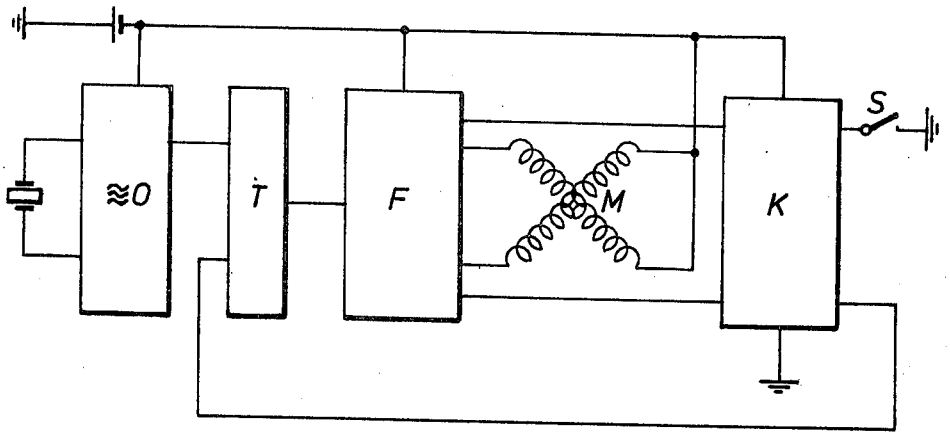
FIG. 1 is a block circuit diagram of one form of circuit arrangement in accordance with the invention.
Figure 2:
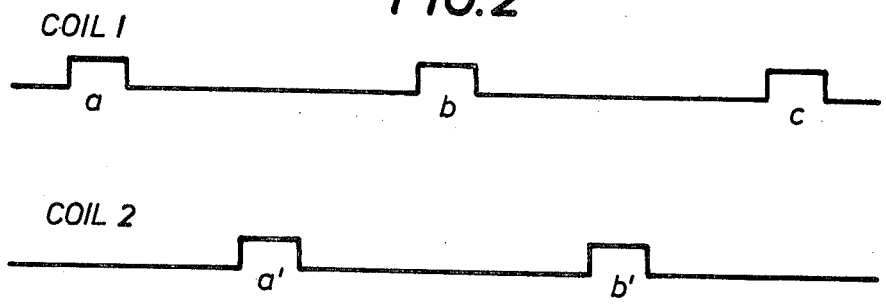
FIG. 2 is a pulse diagram associated therewith.

Referring now to the drawings, FIG. 1 shows a block circuit diagram of the circuit in accordance with the invention. It is not necessary to go into the construction of the individual circuit parts here, since their realization does not present any great difficulties. A gate circuit T is connected by one input to an oscillator stage O. The output of the gate circuit leads to the frequency divider stage F, which also contains pulse shaper stages and the necessary output stages. For example, 16 frequency divider stages may follow the two pulse former stages. These pulse shaper stages each emit a pulse every two seconds, which are so displaced relative to each other within the pulse stages in accordance with the diagram of FIG. 2, that the subsequently connected output stages are switched over after each second and thus the current direction through the ballast resistance changes after each second. The motor M therefore changes, in the case of an alternating stepping switch motor, after one second its direction of rotation and in each case assumes one of its two preferred positions. In the case of a motor with only one direction of rotation, this motor is rotated further by 180° after, each second.

The control logic unit K is connected to the frequency divider stages, which control logic unit interrogates the position of the frequency divider stages, stores this information and on closing of the switch S provides for a disconnection of the oscillator O from the frequency divider stage F at the correct moment. The oscillator, the frequency divider stages and the control logic unit are connected independently of each other to the supply voltage so that, independently of the position of the switch S, the oscillator operates constantly and the information contained, in each case, in the frequency divider is retained. The control logic unit is preferably constructed with flank controlled trigger stages which are set by the front or rear flanks or the setting pulses in the frequency divider. The control logic unit is so constructed that, on closure of the switch S, the oscillator is separated from the frequency divider at the point in time which for example the emission of the pulse $a'$ lies immediately ahead, i.e. occurs immediately upon reconnection of the oscillator to the frequency divider. If, after the setting of the clock, the switch S is opened again, this pulse $a$ is passed immediately to the motor M which thus rotates directly after the opening of the switch S. The emission of the pulse $a'$ is triggered by the first oscillator pulse, which arrives at the frequency divider from the oscillator. From this results the fact that the starting time of the motor amounts to maximally $1/f_{osc}$.

If an AND-gate is used for the gate circuit, the control logic unit, on setting the clock, emits a logic 0 to the gate. If, on the other hand, an OR-circuit is used, the control logic must emit a logic 1 in order to trigger the disconnection of the oscillator from the frequency divider.

As switch S there is used, for example, an electronic switch the position of which is dependent on the change of the external magnetic field, a voltage, a mechanical load or on temperature. For this, for example, magnetic diodes, photodiodes or photo transistors, piezo elements or thermistors are suitable.

It will be understood that the above description of the present invention is susceptible to various modifications changes and adaptations.

What is claimed is:

1. In a circuit arrangement for a quartz-controlled electric clock composed of an oscillator stage producing a train of oscillations at a fixed frequency, frequency divider means having an input connected to receive a train of oscillations and at least one output providing pulses at a rate which is a fixed fraction of the frequency of the train of oscillations connected to its input, the frequency divider means containing switchable means which assume a different switching state in responce to each oscillation cycle applied to the divider means and which cause a pulse to be applied to each divider means output upon assuming a selected switching state, and a stepping switch motor having drive coils connected to the divider means output for receiving the pulses in order to effect driving of the motor, the improvement wherein said switchable means remain in their existing switching state upon termination of delivery of oscillations to said divider means input, and said arrangement comprises:

a gate circuit connected between said oscillator stage and said frequency divider means input and having a control input, said gate circuit passing the train of oscillations from said oscillator stage to said frequency divider means input when a first control signal is present at said control input and blocking passage of such oscillations when a second control signal is present at said control input;

control logic means having inputs connected to said frequency divider means to receive signals indicating the switching state of said switchable means, an output connected to said control input of said gate circuit to supply control signals to said control input, and an external control input, said control logic means being arranged to normally apply the first control signal to said control input and to monitor the switching state of said switchable means in a manner such that after application of an external control signal to said external control input, the second signal is produced at said logic means output only at the instant when said switchable means assumes that switching state which immediately precedes the selected switching state at which a pulse is applied to said divider means output, there being no current flow through said driving coils when said switchable means are in such immediately preceding state; and switch means connected to said logic means external control input and switchable into a condition for applying the external control signal thereto.

2. A circuit arrangement as defined in claim 1, wherein said control logic unit is constructed with flank-controlled trigger stages which are set by the leading or trailing flanks of the setting pulses in said frequency divider.

3. A circuit arrangement as defined in claim 1, wherein said switch comprises an electronic switch the position of which is dependent on an external condition.

4. A circuit arrangement as defined in claim 1 wherein said gate circuit comprises a conjunctive circuit.

5. A circuit arrangement as defined in claim 1 wherein said gate circuit is a disjunctive circuit.

6. A circuit arrangement for a quartz controlled electric clock comprising:

an oscillator stage connected to continuously produce a train of oscillations at a fixed frequency;

frequency divider means for converting a train of input oscillations into a train of output drive pulses of lower frequency than the oscillations, each input oscillation placing said frequency divider means in a respectively different switching state and the production of an output drive pulse corresponding to a first selected one of the switching states;

a stepping motor having drive coils connected to said frequency divider means for receiving the output drive pulses therefrom in order to drive said motor;

a gate circuit connected between said oscillator stage and said frequency divider means for selectively supplying the oscillations produced by said oscillator stage to said frequency divider means; and control logic means connected to monitor the switching state of said frequency divider means and to control the operation of said gate circuit to open said gate circuit in order to block delivery of oscillations to said frequency divider means after application of a command signal to said logic means at a moment when said frequency divider means is in a second selected switching state, which immediately precedes said first selected switching state;

said frequency divider means being connected to remain in its existing switching state after termination of delivery of input oscillations thereto and to prevent current flow through said drive coils when in its second selected switching state.

* * * * *